United States Patent [19]

O'Brien

[11] Patent Number: 4,989,735

[45] Date of Patent: Feb. 5, 1991

[54] DISPENSING CARTON

[75] Inventor: Patrick J. O'Brien, Hackensack, N.J.

[73] Assignee: Container Corporation of America, Clayton, Mo.

[21] Appl. No.: 567,610

[22] Filed: Aug. 13, 1990

[51] Int. Cl.[5] ..... B65D 5/70

[52] U.S. Cl. ..... 206/621.6; 206/621.3; 206/622; 206/626

[58] Field of Search ..... 206/621.3, 621.4, 621.6, 206/621.7, 622, 626, 631.2

[56] References Cited

U.S. PATENT DOCUMENTS

| | | | |
|---|---|---|---|
| 2,470,388 | 5/1949 | Ball | 206/622 |
| 3,438,565 | 4/1969 | Lugt et al. | 206/626 |
| 3,563,447 | 2/1971 | Katzenmeyer | 206/621.7 |
| 3,971,506 | 7/1976 | Roenna | 206/626 |
| 4,909,395 | 3/1990 | Weissman | 206/621.3 |
| 4,944,406 | 7/1990 | Zehnal | 206/621.4 |

*Primary Examiner*—Gary E. Elkins
*Attorney, Agent, or Firm*—Richard W. Carpenter

[57] ABSTRACT

A reclosable dispensing carton having in the top wall a partially detachable, hingedly attached, locking tab that is formed from portions of the overlapped top closure flaps and that has projecting shoulders that are engageable with adjacent portions of the top closure flaps to provide a relatively sift-proof reclosure arrangement.

9 Claims, 2 Drawing Sheets

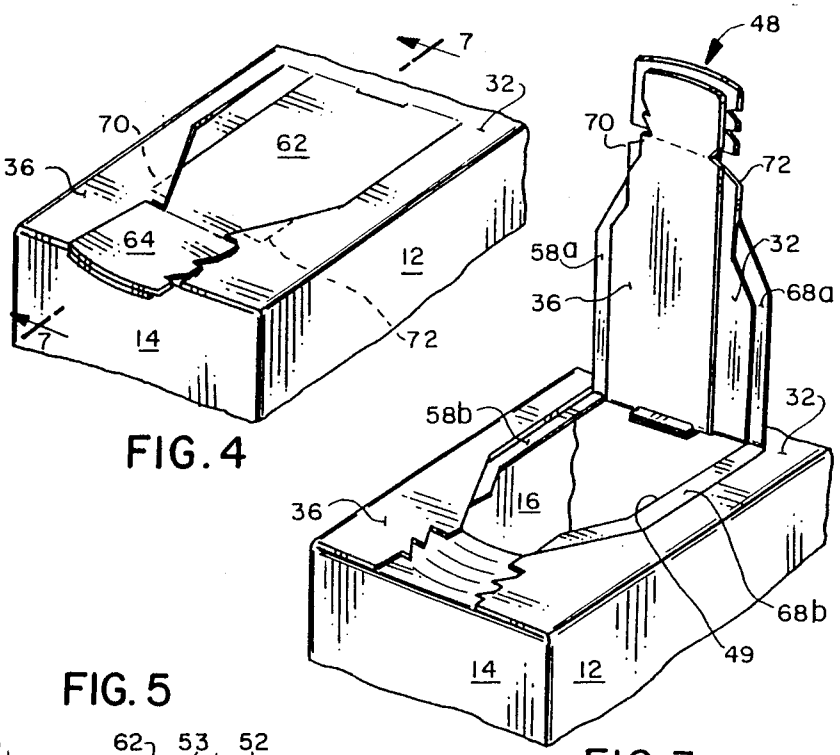
FIG. 3
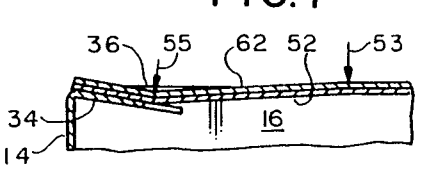
FIG. 7
FIG. 4
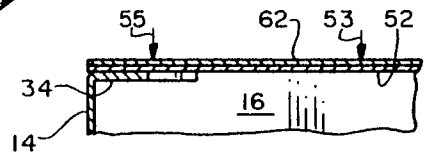
FIG. 5
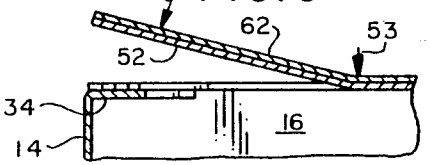
FIG. 6
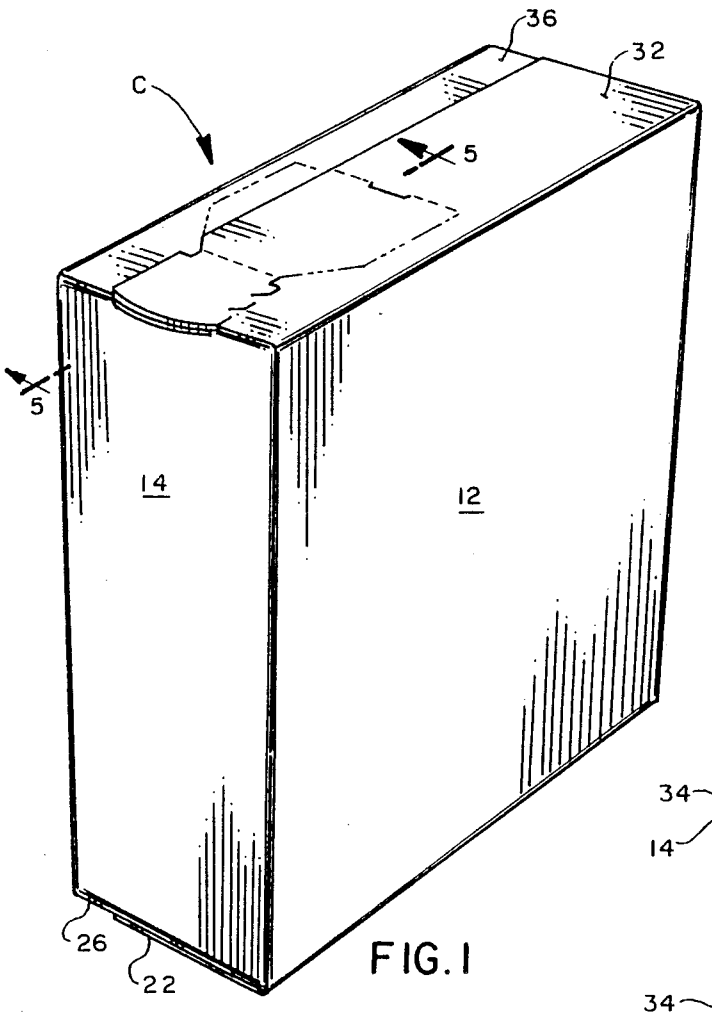
FIG. 1

DISPENSING CARTON

BACKGROUND OF THE INVENTION

1. Field of the Invention

This invention relates to dispensing cartons of the type used in packaging of granular, crystal, and powder products, as well as cereals, pasta products, and other similar dry items, and more particularly to an improved reclosable pour spout type dispensing opening feature for the upper wall of the carton.

2. Description of Background Art

A background art search directed to the subject matter of this application and conducted in the United States Patent and Trademark Office disclosed the following United States Letters Patent:

| | | | |
|---|---|---|---|
| 2,979,249 | 3,096,922 | 3,096,921 | 3,147,905 |
| 3,187,977 | 3,187,978 | 3,262,630 | 3,266,055 |
| 3,352,692 | 3,387,763 | 3,395,848 | 3,606,133 |
| 3,894,680 | 4,019,673 | 4,122,948 | 4,482,056 |
| 4,706,875 | 4,799,594 | | |

None of the patents uncovered in the search discloses a dispensing carton top wall having a detachable, reclosable, locking tab comprising a pair of sections, formed from material of major closure flaps, located adjacent the outer corners of the respective flaps, and having sides defined by spaced, reverse, partial cut lines that form flanges therebetween for engagement with tab shoulders to provide a sift-proof reclosure.

SUMMARY OF THE INVENTION

It is the primary object of the present invention to provide a partial overlap, seal end carton with a reclosable pour spout arrangement in the top wall thereof.

A more specific object of the invention is to provide a dispensing arrangement for the top wall of a seal end carton which includes a locking tab comprising separate tab sections formed from material of the overlapping major closure flaps and having side edges defined by spaced cut lines that form flanges which are engageable with shoulders on the tab to provide a sift-proof reclosure arrangement.

These and other objects of the invention will be apparent from an examination of the following description and the drawings.

BRIEF DESCRIPTION OF THE DRAWINGS

FIG. 1 is a perspective view of a dispensing carton having a closure arrangement embodying features of the present invention;

FIG. 3 is a enlarged perspective view of the front upper corner of the carton illustrated in FIG. 1, but shown in an open position after the locking tab has been detached and pulled partly away from the top wall of the carton;

FIG. 4 is a view similar to FIG. 3, but with the carton shown in a closed condition, after initial opening and with the locking tab engaged with the top wall of the carton to effect a sift-proof reclosure;

FIG. 5 is a fragmentary, transverse, vertical sectional view taken on line 5—5 of FIG. 1;

FIG. 6 is a view similar to FIG. 5, but with the lock tab shown in an open position as illustrated in FIG. 3; and FIG. 7 is a view similar to FIGS. 5 and 6, but with the tab shown in the reclosed position as illustrated in FIG. 4.

Figure 2:
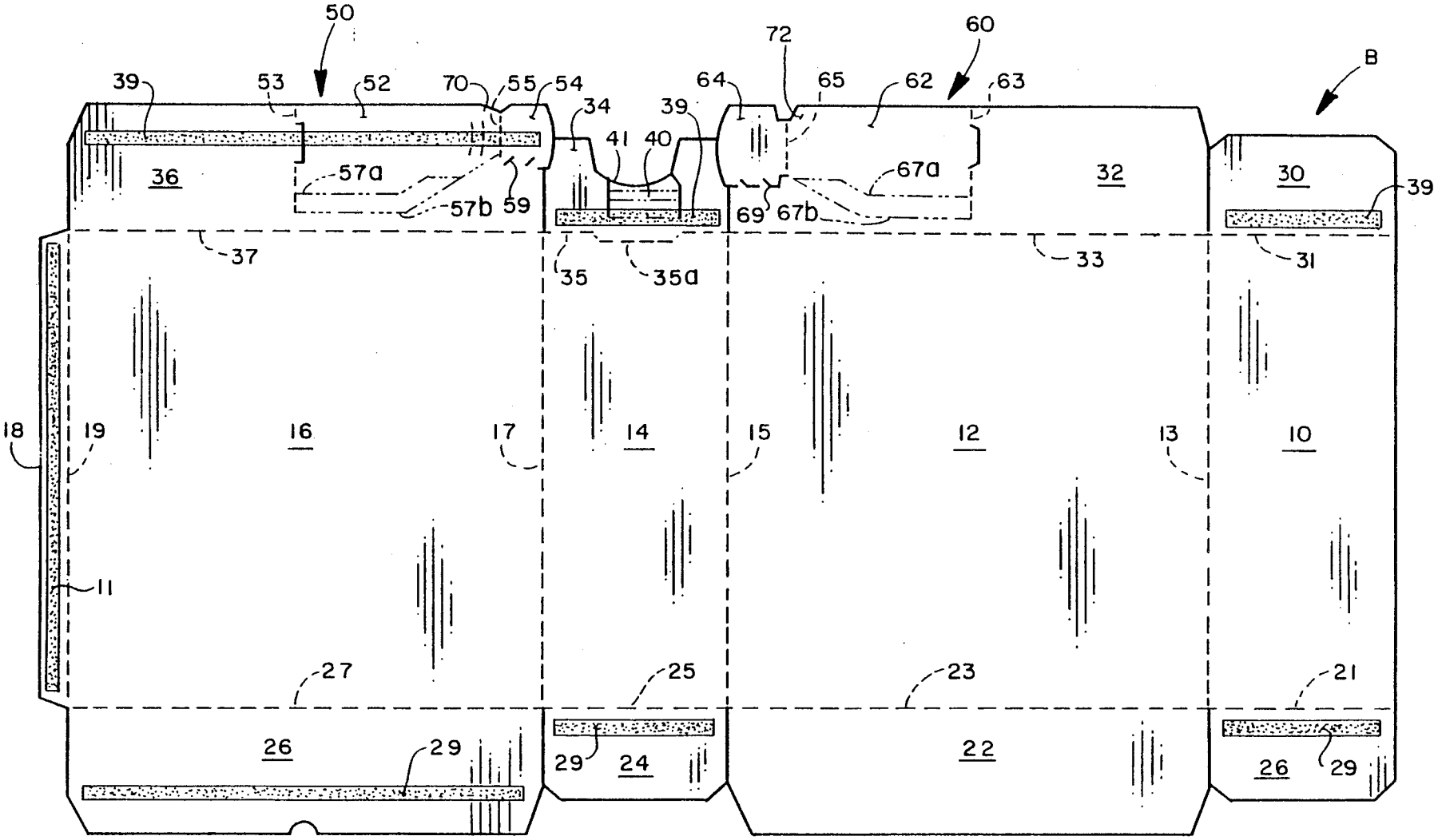
FIG. 2 is a plan view of a blank of foldable sheet material from which the carton illustrated in the other views may be formed.

It will be understood that, for purposes of clarity, certain elements may have been intentionally omitted from certain views where they are belived to be illustrated to better advantage in other views.

DESCRIPTION OF THE PREFERRED EMBODIMENT

Turning now to the drawings for a better understanding of the invention, it will be seen that a dispensing carton embodying features of the invention, and indicated generally at C in FIG. 1, may be formed from a unitary blank B of foldable sheet material, such as paperboard, illustrated in FIG. 2.

The body portion of the carton includes a first minor side wall panel 10, a first major side wall panel 12, a second minor side wall panel 14, a second major side wall panel 16, and a glue panel 18, which are foldably joined to each other along parallel fold lines 13, 15, 17, and 19, all of which extend transversely of blank B.

When the glue panel 18 is secured, as by an adhesive indicated at 11, to first minor side wall panel 10 to form a manufacturer's joint in a conventional manner, a tubular body structure is formed which is open at the upper and lower ends.

The lower end of the carton has a bottom closure arrangement that includes a pair of minor bottom closure flaps 20 and 24, foldably joined to lower edges of minor side wall panels 10 and 14 along fold lines 21 and 25, respectively, and a pair of major bottom closure flaps 22 and 26, foldably joined to lower edges of major side wall panels 12 and 16 fold lines 23 and 27, respectively. The bottom closure flaps may be folded into overlapping relation and secured to each other by an adhesive indicated at 29 applied to bottom closure flaps 20, 24, and 26 as illustrated in FIG. 2.

The upper end of the carton has a similar closure flap arrangement that includes a minor closure flaps 30 and 34, foldably joined to the upper edges of minor side wall panels 10 and 14 along fold lines 31 and 35, respectively, and major closing flaps 32 and 36, foldably joined to the upper edges of major side wall panels 12 and 16 along fold lines 33 and 37, respectively. Fold line 35 has an offset central portion **35*a* to permit a center portion of minor closure flap 34** to be depressed slightly in the area where the free end of locking tab is secured to the flap, as described later in the specification.

The top closure flaps may be secured to each other in overlapping relation by an adhesive indicated at 39 applied to flaps 30, 34, and 36 as illustrated in FIG. 2.

Top wall inner minor closure flap 34 may be provided in its central area with a plurality of cuts 41 to assist in delamination when the locking tab 48, which is adhesively attached to flap 34, is pulled away to open the carton in a manner hereinafter described. Panel 34 may also be provided in the central area with a recess 41 in the outer edge thereof.

As best seen in FIGS. 2 and 3, a locking tab 48, comprising a pair of overlying, adhesively interconnected sections 50 and 60, is provided in the top wall of the carton.

Locking tab section 50, which is formed material cut from major closure flap 36, includes a body portion 52, foldably joined at its rear edge along fold line 53 to major closure flap 36, and a head portion 54, foldably joined at its rear edge along fold line 55 to the front edge of body portion 52.

It will be seen that one side of the body portion 52 is defined by a pair of spaced, reverse, partial cuts 57*a*, in the outside of the carton, and 57*b* in the inside of the carton, that form a pair of flanges 58*a* and 58*b* on the sides of the lock flap section and the closure flap, respectively. One side of the head section 54 is formed by a single weakened line of tear 59.

The other locking tab section 60 is similar in construction and includes body portion 62, foldably joined at its rear edge along fold line 63 to flap 32, and a head portion 64, foldably joined on fold line 65 to body portion 62. One side of the body portion is also defined by a pair of spaced, reverse, partial cuts 67*a* and 67*b* which form flanges 68*a* and 68*b* therebetween in the locking tab section and closure flap, respectively. One side of head portion 64 is defined by a weakened line of tear 69.

As best seen in FIG. 3, the body portion of locking tab 50 is provided with a shoulder 70, and the body portion of locking tab section 60 is provided with a shoulder 72. The shoulders are each located at the forward end of the body portion immediately adjacent the head portion.

After the carton has been filled and the bottom closed in a conventional manner, the upper end of the carton is closed by first folding in the minor closure flaps 30 and 34 and then folding over the major closure flaps 32 and 36, with flap 32 overlapping 36. Locking flaps 50 and 60 are adhesively secured to each other, and the free end of the innermost locking flap head portion 54 is adhesively secured to minor closure flap 34 in the area of the previously described cuts 41.

In order to open the carton, the locking tab 48 is partially detached from the carton top wall and pulled away, as illustrated in FIG. 3, to leave a dispensing opening 49 for removing the contents of the carton.

As the locking tab is detached, flanges are formed on the sides of the closure flaps and the locking flap sections because of the spaced, reverse, partial cuts.

In order to reclose the carton, the locking tab 48 is pushed down against the top wall of the carton, as best illustrated in FIG. 7. When this happens, the shoulders 70 and 72 on the locking tab sections engage the edges of the respective major closure flaps, as best seen in FIG. 4, to provide a relatively sift-proof, locked closusre arrangement for the upper wall of the carton.

The carton can be opened and reclosed as many times as desired, and a sift-proof reclosable arrangement will always be achieved when the carton is reclosed.

What is claimed is :

1. An easy opening, reclosable, dispensing carton formed from a unitary blank of foldable sheet material, such as paperboard, comprising:

(a) pairs of opposed major and minor side wall panels foldably interconnected to form a tubular structure open at the ends;

(b) a bottom closure including bottom closure flaps foldably joined to lower edges of said side wall panels and secured to each other in overlapping relation;

(c) a top closure including a pair of first and second outer major top closure flaps and a pair of inner minor closure flaps foldably joined to upper edges of said major and minor side wall panels, respectively, and secured to each other in overlapping relation;

(d) said top closure including a multi-ply locking tab having overlying, adhesively interconnected, first and second sections formed from material of said first and second major top closure flaps, respectively, and being partially detachable from and hinged to their respective major closure flaps to provide an opening for pouring contents from the cartons;

(e) said locking tab sections being located at corresponding corners of their respective major top closure flaps and each including:

(i) a body portion having a rear edge hinged to its related major closure flap and having an inboard side edge defined by a pair of spaced, reverse, partial cut lines that form a flange therebetween;

(ii) a head portion having a rear edge hinged to a front edge of said body portion and having an inboard side edge defined by a single weakened line of tear;

(iii) a shoulder adapted to be tucked under an adjacent edge of the other of said major closure flaps upon reclosure to provide a relatively sift-proof reclosure of said dispensing opening after initial opening of the carton;

(f) the head protion of said locking tab sections being releasably adhered to an outer surface of an adjacent inner minor closure flap intermediate opposing inboard edges of said outer major closure flaps.

2. A dispensing carton according to claim 1, wherein each of said shoulders is located at the forward end of a body portion adjacent its related head portion.

3. An easy opening, reclosable, dispensing carton formed from a unitary blank of foldable sheet material, such as paperboard, comprising:

(a) pairs of opposed major and minor side wall panels foldably interconnected to form a tubular structure open at the ends;

(b) a bottom closure including bottom closure flaps foldably joined to lower edges of said side wall panels and secured to each other in overlapping relation;

(c) a top closure including a pair of first and second outer major top closure flaps and a pair of inner minor closure flaps foldably joined to upper edges of said major and minor side wall panels, respectively, and secured to each other in overlapping relation;

(d) said top closure including a multi-ply locking tab having overlying, adhesively interconnected, first and second sections formed from material of said first and second major closure flaps, respectively, and being partially detachable from and hinged to their respective major closure flaps to provide a dispensing opening for pouring contents from the carton;

(e) said locking tab sections being located at corresponding corners of their respective major top closure flaps and each having;

(i) a rearward end hinged to its related major top closure flap;

(ii) an inboard side edge defined by a pair of spaced, reverse, partial cut lines;

(iii) a shoulder adapted to be tucked under an adjacent edge of the other of said major closure flaps upon reclosure to provide a relatively sift-proof reclosure of said dispensing opening after initial opening of the carton;

(f) said locking tab having a free end releasably adhered to an outer surface of an adjacent inner minor closure flap.

4. A dispensing carton according to claim 3, wherein each of said locking tab sections includes a body portion hinged to its related major top closure flap and a head portion hinged to its related body portion.

5. A dispensing carton according to claim 4, wherein each of said shoulders is located at the forward end of a body portion adjacent its related head portion.

6. A dispensing carton according to claim 3, wherein said head portion has one side defined by a single weakened line of tear.

7. A unitary blank of foldable sheet material, such as paperboard, for use in forming an easy opening, reclosable, dispensing carton, said blank bring cut and scored to provide: material, such as paperboard, comprising:

(a) a body portion including the following panels serially arranged and foldably joined to each other along parallel fold lines extending transversely of the blank: a first minor side wall panel, a first major side wall panel, a second minor side wall panel, a second major side wall panel, and a glue panel;

(b) pairs of major and minor top and bottom closure flaps foldably joined to upper and lower edges of said major and minor side wall panels, respectively;

(c) said major top closure flaps including locking tab sections located at adjacent upper corners thereof, each section including:

(i) a body portion having a rear edge hinged to its related major top closure flap and having an inboard side edge defined by a pair of spaced, reverse, partial cut lines that form a flange therebetween;

(ii) a head portion having a rear edge hinged to a forward edge of said body portion and having an inboard side edge defined by a single weakened line of tear;

(iii) a shoulder adapted to be tucked under an adjacent edge of the other of said major closure flaps upon reclosure to provide a relatively sift-proof reclosure of said dispensing opening after initial opening of the carton.

8. A blank according to claim 7, wherein each of said shoulders is located at the forward end of a body portion adjacent its related head portion.

9. A blank according to claim 7, wherein said head portion has one side defined by a single weakened line of tear.

* * * * *